United States Patent [19]

Gilliam

[11] 4,386,915

[45] Jun. 7, 1983

[54] DRY LAND TRICK SKI TRAINER

[75] Inventor: Barry R. Gilliam, Maitland, Fla.

[73] Assignee: Airoex Products, Inc., Apopka, Fla.

[21] Appl. No.: 207,645

[22] Filed: Nov. 17, 1980

[51] Int. Cl.[3] ..... A63B 69/18

[52] U.S. Cl. ..... 434/253; 441/68; 272/97; 272/146

[58] Field of Search ..... 434/253, 247; 272/97, 272/146, 118, 1 B, 32, 17, 136; 9/310 G

[56] References Cited

U.S. PATENT DOCUMENTS

| | | | |
|---|---|---|---|
| 323,792 | 8/1885 | Coop | 272/118 |
| 1,565,484 | 12/1925 | McWhirter | 272/146 |
| 1,585,748 | 5/1926 | Wendelken | 272/146 |
| 2,815,951 | 12/1957 | Baldanza | 272/97 |
| 3,088,733 | 5/1963 | Ayres | 272/146 |
| 3,100,639 | 8/1963 | Bonewitz | 272/146 |
| 3,582,066 | 6/1971 | Keryluk | 272/97 |
| 3,593,994 | 7/1971 | Anbar | 272/146 |
| 3,752,474 | 8/1973 | Macabet | 272/97 X |
| 3,877,097 | 4/1975 | Gentry | 9/310 G |
| 4,026,548 | 5/1977 | Birdwell | 272/136 |

FOREIGN PATENT DOCUMENTS

| | | | |
|---|---|---|---|
| 52-17926 | 2/1977 | Japan | 272/136 |

OTHER PUBLICATIONS

Washington Post, 2-2-1972, p. C22.

*Primary Examiner*—Richard J. Johnson

[57] ABSTRACT

A dry land trick ski trainer is disclosed comprising a circular platform disposed at 2½ to 10 degrees attitude and rotatingly supported at its center on a base. The circular platform is provided with a ski boot and markings to show the proper placement of feet. A ski rope is provided, one end of which is attached through a pulley to a set of weights so as to simulate the pull of a boat.

3 Claims, 8 Drawing Figures

DRY LAND TRICK SKI TRAINER

BACKGROUND OF THE INVENTION

The invention relates to a training apparatus for ski instruction and more particularly to an apparatus designed for the instruction of trick ski maneuvers on dry land.

Skiing has become an increasingly popular sport, however, it has been dealt a setback because of the energy crisis. In response to the higher cost of energy, trick skiing has increased in popularity since trick skiing is performed at a lower rate of speed (between ten to seventeen miles per hour) as compared to that necessary for slalom or standard skiing which requires a boat speed of eighteen to thirty-six miles per hour. Trick skiing involves the performance of turns and other maneuvers in the water.

The types of tricks done in competition are variations of turning 90, 180, 360, 540 and 720 degrees. They are divided into five categories:

1. Surface turns (tricks done on the surface of the water).
2. Wake turns (tricks that involve jumping off the boat wake and making turns in the air).
3. Stepover turns (tricks that involve lifting a ski or free foot over the tow rope while turning).
4. Toehold turns (tricks that require putting a foot in a top strap on the bridle of the handle and then turning).
5. Combination turns (tricks that involve putting together wake turns with stepovers or wake turns with toeholds).

Competitive trick skiing is a demonstration of these various tricks within a time constraint. It usually consists of two 20-second intervals of skiing. Each interval is referred to as a "pass". In a pass the skier does as many tricks as he or she can perform. No trick can be repeated and there are no required tricks.

Presently training is done by an instructor from the boat verbally instructing the student on how to perform the tricks in the water, then the student attempts to perform them. Several disadvantages of this method are that weather and water conditions are not always conducive for training sessions, and a boat has to be run during the training sessions and therefore due to gas consumption it is more expensive. Still another disadvantage is that the student cannot practice the turns by himself but needs a boat and a boat operator in order to be able to practice.

SUMMARY OF THE INVENTION

The dry land trick ski trainer 10 of the present invention includes a circular platform disposed at 2½ to 10 degree elevation altitude and pivotally supported at its center by a base. The system also includes a ski rope attached to a means for providing tension to the ski rope.

BRIEF DESCRIPTION OF THE DRAWINGS

Further details are explained below with the help of the examples illustrated in the attached drawings in which.

DETAILED DESCRIPTION OF THE PREFERRED EMBODIMENT

Figure 1:
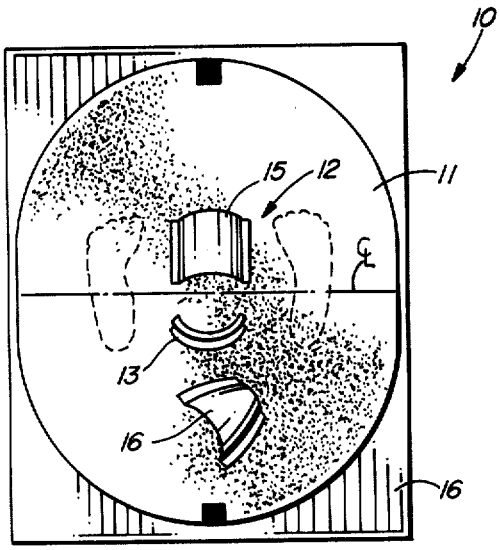
FIG. 1 is a top view of the circular platform of the dry land trainer.

As illustrated in FIG. 1, the dry land trainer of the invention includes a platform 11 preferably covered with a non-slip surface. The platform 11 should be of sufficient width to allow for the placement of the two feet of the student in the typical trick skiing position. It has been found that a twenty-four inch diameter disc is adequate in most cases. Permanently attached to the disc 11 is a boot 12 with a heel portion 13 which is used to simulate slalom ski placement. The boot 12 also includes a front adjustable binder 15 is slideably secured to the disc 11 to accomodate for varying foot sizes. A rear toe piece 16 may be attached to the platform 11 for more advanced simulation. The placement of the rear heel portion 13 of the boot 12 and the toe piece 16 is important for proper simulation of the trick procedure. Conventional two ski placement is determined by placing the ankles directly on the center of the skis. This would ordinarily result in the heel portion 13 of the boot 12 being placed a distance from the center of the skis which is equivalent to the distance from the ankle to the heel of the skier. The general rule for binding placement in slalom trick skiing is to have the center of the instep ½" to 1" in front of the balance point of the ski. This point can be determined by laying the ski across your hand and finding the point where the ski balances. The placement of the rear foot for one ski tricks is important for achieving one ski balance. How to place the rear toe piece depends on which foot is skied forward. The rear binding should be placed at a 45 degree angle with the inside of the rear ankle approximately two inches behind the heel of the front foot. Keeping the foot at this angle maximizes ski control and stability.

This placement may be simulated by placing the ankles one half inch (½") to one inch (1") forward of the centerline or diameter of the platform 11. This would require the heel portion of the boot to be placed closer to the centerline to maintain the proper angle between the ski and the water.

The platform 11 is covered by a non-slip surface 17. In simulating slalom's trick skiing maneuvers, one foot is placed with the heel on the rear ski boot 13 and the front adjustable ski boot is adjusted to the proper position. In slalom simulations the other foot would be placed behind the rear ski boot 13 in the toe piece 16. In simulating trick skiing with two skis the front ski boot 15 and rear ski boot 13 are not used, rather the feet are placed on the non-slip surface 17 at the correct position astride of the ski boots 13, 15, and 17. Thus the purpose of the non-slip surface 17 is to insure the maintenance of the feet at the proper position.

The center line of the circular platform 11 is marked to facilitate the placement of the feet in the proper position. In two skis trick skiing the ankles are placed on the center line of the skis, and thus in the simulation used in the dry land trainer, the ankles are placed on the mark (centerline) 19.

Figure 2:
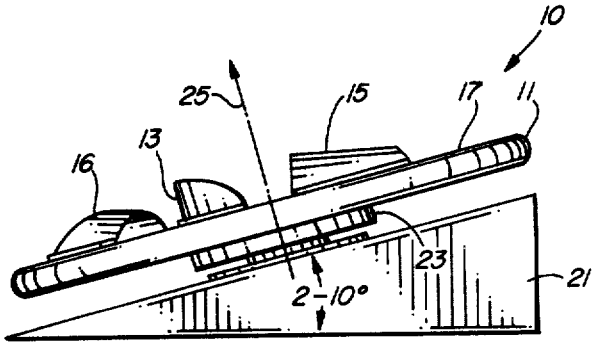
FIG. 2 is a side view of the circular platform of the present invention.

As shown in FIG. 2 the circular platform 11 is disposed at an altitude of 2½ to 10 degrees from a level floor. The circular platform 11 is supported at its center by a wedge-shaped base 21 having bearings 23 which allow the circular platform 11 to rotate about an axis 25 which passes through the center of the circular platform 11 and is perpendicular thereto. The wedge shaped base 21 is desirably approximately the same area as the platform 11. The rotating motion about the axis 25 and the angular placement of the platform 11 closely simulate the effect of proper trick skiing. In order to do a trick skiing maneuver properly, the angular placement of the skis must always be maintained regardless of where the skier is facing.

Figure 3:
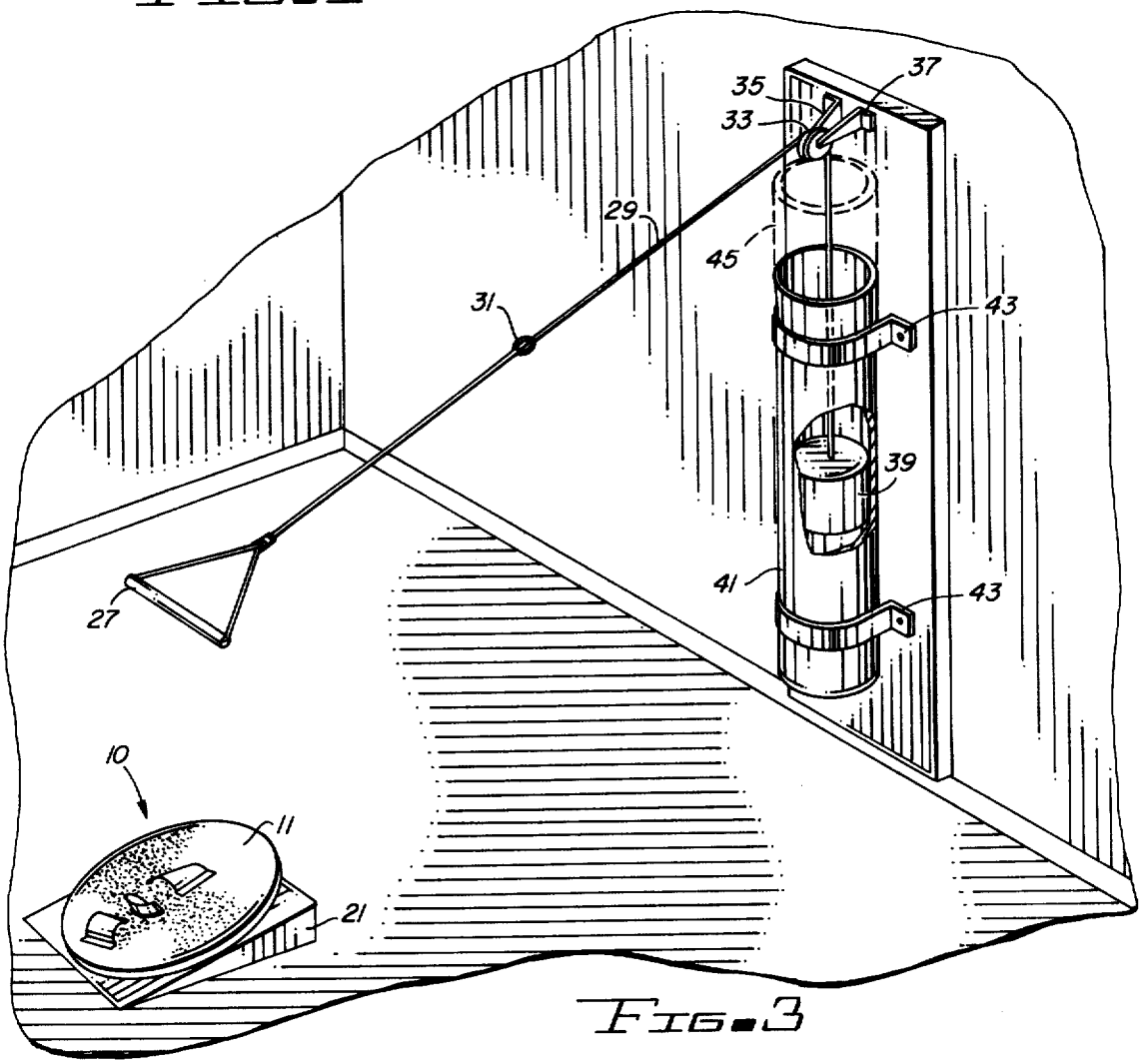
FIG. 3 is a schematic showing the ski rope and a means for providing tension to the rope.

While simulating the angular placement and movement of the feet it is necessary in a training device, it is also necessary, as illustrated in FIG. 3 to have proper simulation of the pull of the boat. To simulate the pull of the boat a ski handle 27 may be provided with a dry land trainer 10. It should be pointed out that many trick skiers become accustomed to their own handles and thus a rope 29 is provided with a ring 31 to which the skier may attach his own personal ski handle 27. The ski rope 29 passes through a pulley 33 which is connected to a rod 35 attached to plate 37. The plate 37 may be secured permanently to a wall. Weights 39 are attached to the end of the rope 29 and are surrounded by a tube 41 which may be made of plastic. The tube 41 is provided to prevent the swinging of the weights, to protect the walls, and to maintain the vertical alignment of the weights so as to reduce friction on the pulley 33 so that uneven forces on the rope 29 are avoided. The tube 41 is attached to the wall by means of brackets 43. The pulley 33 is disposed so that the rope 29 maintains the weights 39 substantially at the center of tube 41. As the weight of the skier varies, lead weights contained in the cylinder may be increased or decreased to accomodate the size of the person. The typical trick skier is pulled by a fifteen pound force and thus typically the weights 39 will be fifteen pounds. However, in order to accomodate the difference in sizes of persons, weights of eight, ten, fifteen, and twenty pounds may be available to be connected to the rope 29. The length of the rope 29 may vary so that the distance between the circular platform 11 and the pulley 33 also varies. However, it is important to maintain the proper placing of the circular platform 11 and this is done by placing it so that when the skier is in position the weights are halfway away from the top of the cylinder 41.

An additional twelve inch tube 45 may be provided if the travel of the weights varies more than the length of tube 41.

Having described the ski trainer 10 in detail a short description of the basic tricks performed in trick skiing is important to demonstrate how the trainer 11 is used.

Surface Turns—Basic surface turns are simple tricks. The key to learning them is remembering that surface turns need to be rotated smoothly and slowly. The knees should always be bent. The head should be kept up and the handle at the waist.

The two most common falls are falling towards the boat while skiing backwards and having the skis stop during rotation. These may be caused by either the handle has gotten away from the skier's body or the skier's body is too erect and stiff. If the skis are stopping during rotation, the skier is either spinning too fast, has the head down during the trick, or the handle has strayed away from the skier's body.

Wake Turns—Wake turns use the same basic principles as surface turns, with some other considerations added. The keys to successful execution are: letting the boat wake do the work for the skier, starting the turn at the peak of the wake (top), keeping the handle at the waist during the entire trick, keeping the head up, spinning the turn and passing, not throwing, the handle from hand to hand.

Most people have the mistaken notion that it takes a giant leap at the top of the wake to successfully complete a wake trick. Actually a big push has a tendency to push the skis into the wake and stop ski rotation. When learning wake tricks, concentrate on spinning and passing the handle near the body. Don't worry about clearance until you have mastered the mechanics of the trick.

The most common falls on wake tricks are caused by letting the handle get out away from the body. Any time the handle is not close to the waist the skier will be stretched out; that is, the arms will be straightened and the skier will be pulled toward the boat.

Another common error is turning before reaching the peak of the wake. This problem becomes apparent quickly because the skis normally stop at the start of the rotation, resulting in a quick, hard fall. The same type of fall can result from looking down.

Stepover Turns—To many skiers, stepover turns are the most unusual tricks they try. The key to doing stepovers is believing one can make them. The most challenging part of a stepover is getting the ski, or free leg to go over the rope. To accomplish this, the skier must pull the rope in, keeping both the stepover and ski leg bent, and throw the stepover leg over the rope while turning.

The most common fall is leaning away from the boat. This is usually caused by not bending the ski leg and by not having the handle in during the turn.

Toe Turns—Toe turns can be more difficult to mentally accept that to perform. To initiate the turn, a skier must bend the ski leg and give a slight hop. During the turn, the skier keeps his shoulders level, the toehold foot in and the ski leg bent.

The most common error is falling away from the boat on the toe back to front. This fall is caused either by letting the toehold leg straighten or by having the upper body too far back when coming frontward.

Figure 4A:
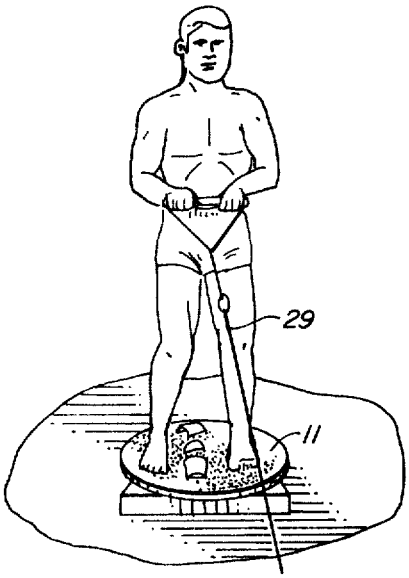
FIGS. 4 A–B illustrates the use of the dry land trainer by a student.
Figure 4B:
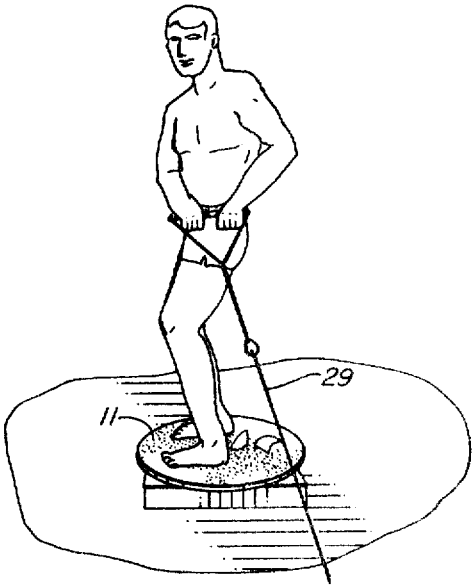

A side slide maneouvre is a two ski trick. The simulation of this trick is illustrated in FIGS. 4A–B. First, as illustrated in FIG. 4A, the student pulls the rope handle to the waist. The constant pull of the boat is simulated by the pull of the weights 39 on the rope 29. The student then turns to the right by shifting the shoulders in that direction. The platform 11, as shown in FIG. 4B rotates as the skier's weight shifts. As the platform 11 rotates the angular placement of the platform 11 will simulate a leaning away from the boat which is necessary for the trick.

Figure 5A:
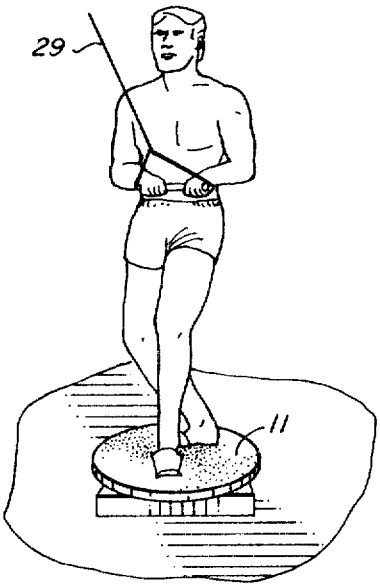
FIGS. 5 A–C illustrates the use of the dry land trainer by a student.
Figure 5C:
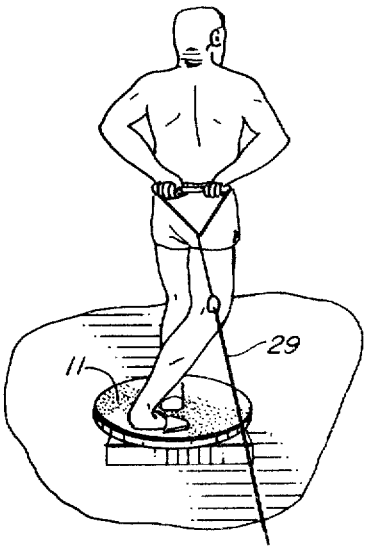
Figure 5B:
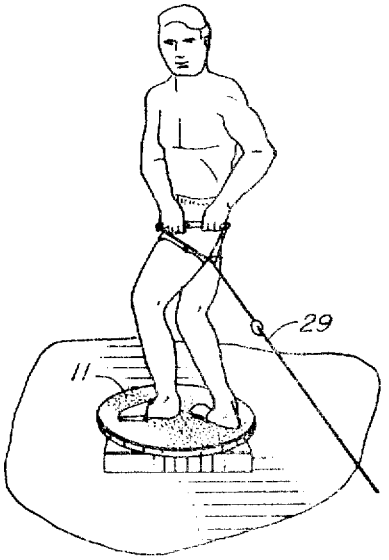

A front to back turn on a single ski is simulated on the trainer 10 as illustrated in FIGS. 5A–C. First, the student pulls the ski rope handle 27 to the waist and begins initiating a turn (FIGS. 5A–5B). The student then releases the right hand from the handle while continuing to rotate (FIG. 5B). After having rotated approximately 180° the student reaches behind him with his right hand and grasps the handle while maintaining the proper angle on the platform (FIG. 5C). While only two tricks are illustrated, it should be understood that all ski tricks may be simulated using the trainer 10.

I claim:

1. An apparatus for facilitating the teaching of trick skiing maneuvers to a skier comprising:

a base adapted to be placed on a horizontal surface;

a platform disposed at an angle of between two and one half (2½) to ten (10) degrees from the horizontal surface;

single degree of freedom means for rotatingly coupling said platform to said base whereby the platform can only rotate about an axis normal to the platform;

a ski handle disposed within reach of the skier when the skier is on said platform;

a rope attached to the ski handle;

a rigid vertical surface;

a pulley coupled to said rope and disposed so that said rope is in a substantially horizontal position when the skier holds said ski handle; and at least one weight attached to the end of the rope and disposed a predetermined distance from said pulley whereby the weight can be raised at least said predetermined distance.

2. The apparatus of claim 1 wherein said at least one weight weighs approximately fifteen pounds.

3. The apparatus of claim 1 further comprising a tubular member disposed around said at least one weight.

* * * * *